US005823093A

United States Patent [19]

Kugelev et al.

[11] Patent Number: 5,823,093

[45] Date of Patent: Oct. 20, 1998

[54] LINER ASSEMBLY WITH A FLUID END CYLINDER

[75] Inventors: Vladimir S. Kugelev, Fort Worth; Mark D. Matzner, Burleson, both of Tex.

[73] Assignee: SPM, Inc., Fort Worth, Tex.

[21] Appl. No.: 964,714

[22] Filed: Nov. 5, 1997

[51] Int. Cl.[6] ..... F01B 29/00

[52] U.S. Cl. ..... 92/128; 417/363

[58] Field of Search ..... 92/128; 417/363; 29/888, 888.02

[56] References Cited

U.S. PATENT DOCUMENTS

| | | | |
|---|---|---|---|
| 4,125,060 | 11/1978 | McGee et al. | 92/128 X |
| 4,621,566 | 11/1986 | Johnson et al. | 92/128 X |
| 4,967,785 | 11/1990 | Young | 92/128 X |
| 5,002,467 | 3/1991 | Talaski et al. | 417/363 |
| 5,024,144 | 6/1991 | Muller | 92/128 X |
| 5,378,121 | 1/1995 | Hackett | 417/363 |

FOREIGN PATENT DOCUMENTS 1127364 1/1984 Russian Federation .

*Primary Examiner*—Hoang Nguyen
*Attorney, Agent, or Firm*—James E. Bradley

[57] ABSTRACT

The fluid end of a reciprocating pump contains a plurality of manifold cylinders for pumping fluid. The fluid end has an improved liner assembly with a shaft, a coaxial piston, and a liner with a liner seal on an outward end. The liner and seal abut an inner wall of the manifold to prevent pressurized fluid leakage between the liner and the manifold. The liner is pressed against the manifold by an adjustment mechanism which is mounted to a housing surrounding the pump. The adjustment mechanism is spaced axially away from the manifold wall and allows the liner to self-adjust to the wall without the need for a liner bushing. A support device is provided for assisting in the vertical alignment of the liner assembly prior to the liner being pressed tightly against the manifold wall.

20 Claims, 3 Drawing Sheets

LINER ASSEMBLY WITH A FLUID END CYLINDER

TECHNICAL FIELD

The present invention relates to oil field pumps; more specifically, the present invention relates to a liner assembly with a fluid end cylinder in a single acting, reciprocating oil field pump.

BACKGROUND ART

Reciprocating oil field pumps are typically driven by a diesel engine. The pump consists of a fluid end or manifold with one or more cylinders and a power end. The fluid end imports and pressurizes fluid before it is expelled. The power end includes a crank shaft which transmits power and motion to a connecting rod which articulates the motion of the crank shaft to a crosshead. Like a piston, the crosshead creates a linear reciprocating motion derived from the crank shaft rotary motion through the connecting rod. The reciprocating motion of the crosshead is applied to a piston by a shaft, and the piston compresses fluid in a cylindrical liner in the fluid end of the pump during the thrust portion of the pump cycle.

Due to the corrosive and abrasive nature of the fluids being pumped, displacement and pressure variations, the liner and piston may wear out quickly. The liner will typically require replacement every 150 hours. To prevent uneven wear, the piston and liner must be aligned with each other when initially assembled and whenever they are replaced. In current designs, the liner is aligned to a fixed part connected with the fluid end cylinder, usually a liner bushing, and the piston is aligned to parts connected with the crosshead. During operation, the crosshead and the adjoining crossways become misaligned and wear unevenly. Uneven wear further reduces the lives of the liner and piston. The liner and piston will be replaced several times for each crossway replacement.

Another problem with prior art liner assemblies is the significant distance required between fluid end cylinders axes. Each pump has several cylinders located side-by-side. The large distance between the cylinders is due to the large diameter of the liner bushing which surrounds each liner. The liner bushing increases the distance between each of the fluid end cylinders axes by at least two wall thickness of the liner bushing, thereby increasing the overall dimensions and weight of the pump. An improved liner design is needed.

DISCLOSURE OF THE INVENTION

The fluid end of a reciprocating pump contains a plurality of manifold cylinders for pumping fluid. The fluid end has an improved liner assembly with a shaft, a coaxial piston, and a liner with a liner seal on an outward end. The liner and seal abut an inner wall of the manifold to prevent pressurized fluid leakage between the liner and the manifold. The liner is pressed against the manifold by an adjustment mechanism which is mounted to a housing surrounding the pump. The adjustment mechanism is spaced axially away from the manifold wall and allows the liner to self-adjust to the wall without the need for a liner bushing. A support device is provided for assisting in the vertical alignment of the liner assembly.

BEST MODE FOR CARRYING OUT THE INVENTION

Figure 1A:
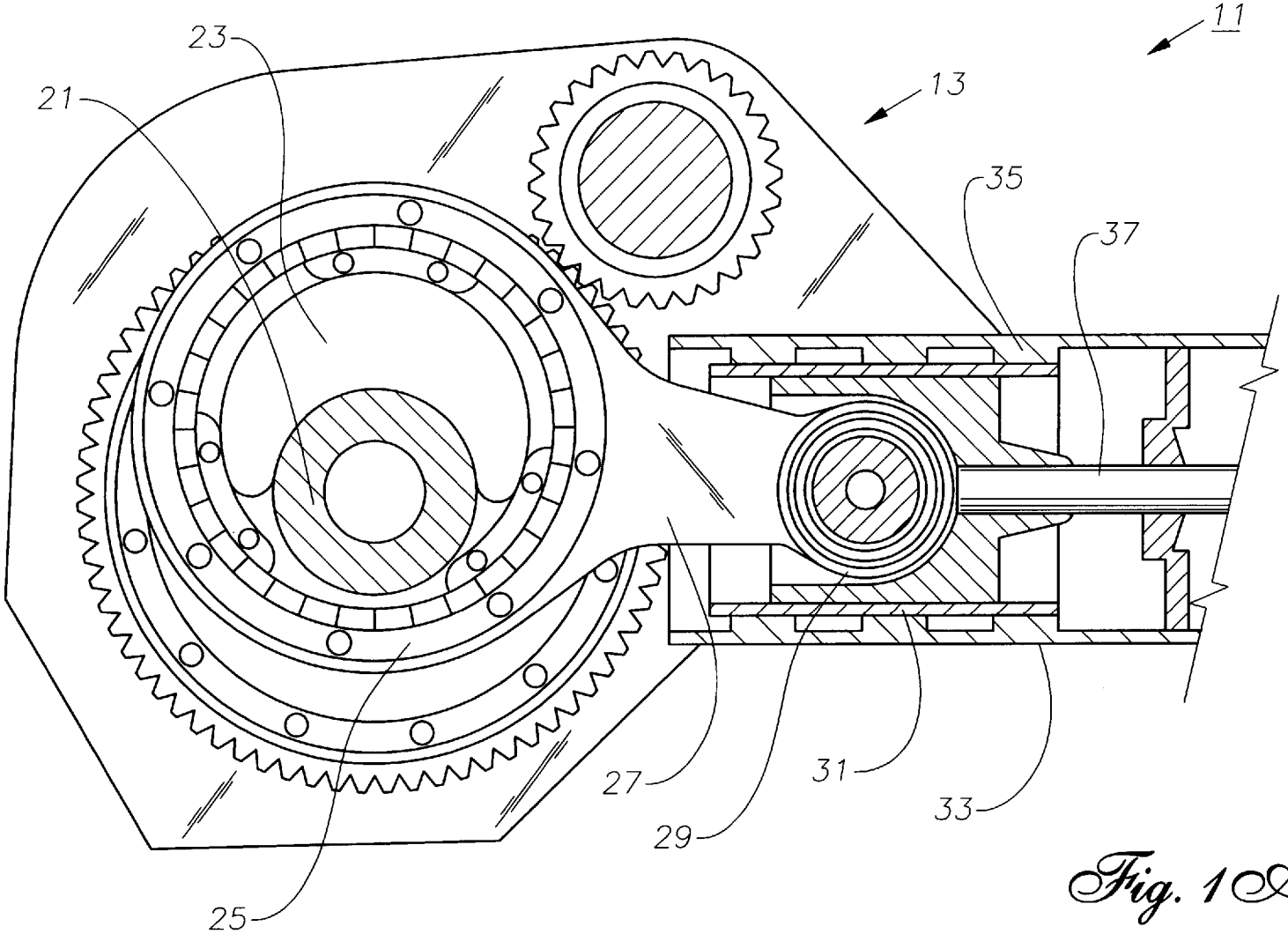
Fig. 1A (PRIOR ART)
FIG. 1A is a sectional side view of the power end of a prior art pump.
Figure 1B:
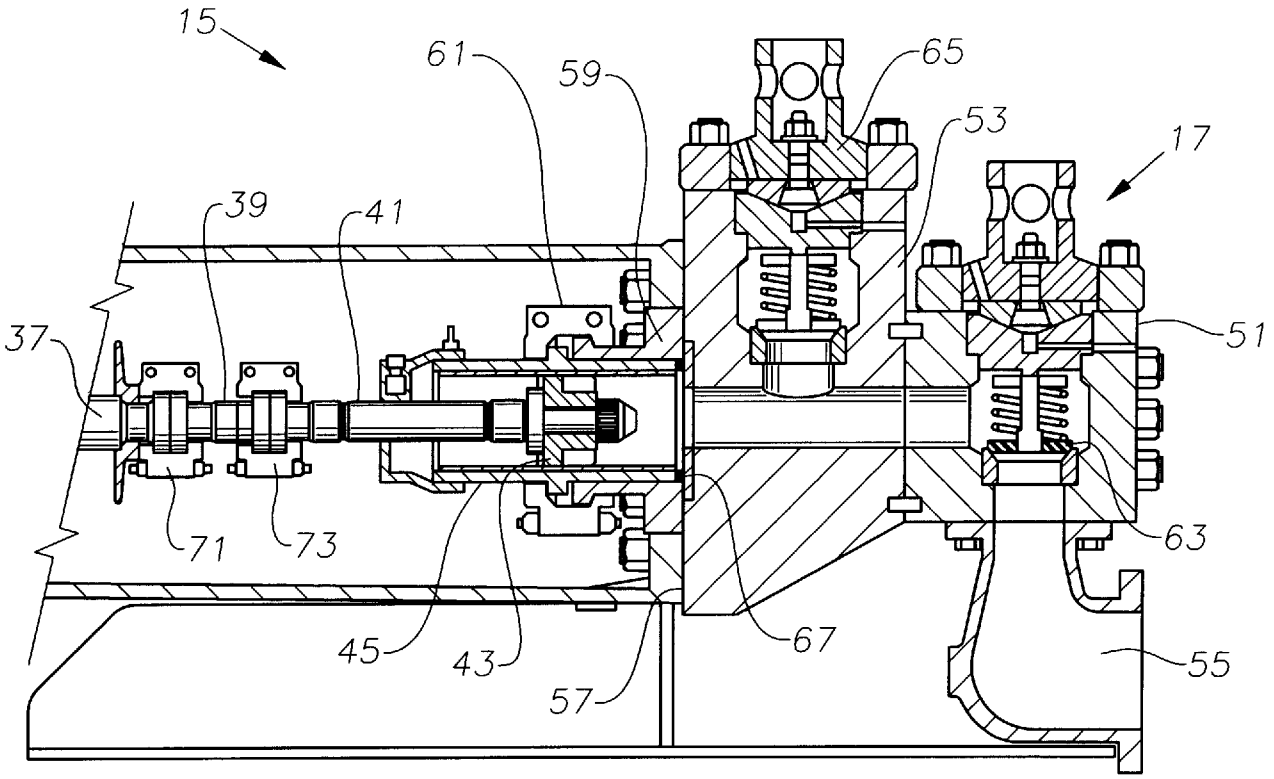
Fig. 1B (PRIOR ART)
FIG. 1B is a sectional side view of the fluid end of the pump of FIG. 1A.

FIGS. 1A and 1B depict a prior art reciprocating pump 11. The pump includes a power end 13 (FIG. 1A) and a manifold or fluid end 15 (FIG. 1B) containing a plurality of fluid cylinders 17 (only one shown). Referring to FIG. 1A, power end 13 includes a crankshaft 21 having an offset portion of a journal 23 which is connected to a first end 25 of a connecting rod 27. Crankshaft 21 moves the first end 25 of connecting rod 27 in a circular motion.

At its second end 29, rod 27 is connected to a crosshead 31. Crosshead 31 moves axially in a back-and-forth motion within a pair of crossways 33, 35. As shown in FIG. 1B, pony rod 37, sub-rod 39, piston rod 41 and piston 43 extend linearly from the fluid end 15 of crosshead 31. As crosshead 31 reciprocates, piston 43 moves axially through a cylindrical liner 45. As piston 43 moves toward fluid cylinders 17, piston 43 pressurizes fluid in cylinders 17.

Each fluid cylinder 17 consists of a suction module 51 and a discharge module 53. Suction module 51 connects to an input port 55. Discharge module 53 includes an output port on an opposite side (not shown). Liner 45 abuts a flat wall 57 of fluid cylinder 17 and is held in place by a liner bushing 59 and a liner clamp 61. Fluid enters input port 55 and is prevented from moving back through port 55 by a valve 63. Piston 43 acts to pressurize fluid and force it out of pump 11 through the output port. A second valve 65 prevents pressurized fluid from returning into the output port. A seal 67 prevents leakage through the connection between liner 45 and discharge module 53.

Prior art pump 11 utilizes special parts such as liner bushing 59 and liner clamp 61 for assembly to prevent relative movement between them and liner 45 during operation. During the initial installation of pump 11, liner 45 mounts to bushing 59 and abuts discharge module 53 with clamp 61. Piston 43 is rigidly connected to crosshead 31 through piston rod 41, sub-rod 39 and pony rod 37 with clamps 71, 73.

Bushing 59 is fixed and its axis is stationary during operation. Crosshead 31 is worn by crossways 33, 35 which cause wear on liner 45 and piston 43. The axial separation of fluid cylinders 17 (only one shown) is increased due to the additional width required by each bushing 59. Thus, the overall size of pump 11 is increased by at least six bushing 59 flange widths (each of the three bushings having two widths).

Figure 2:
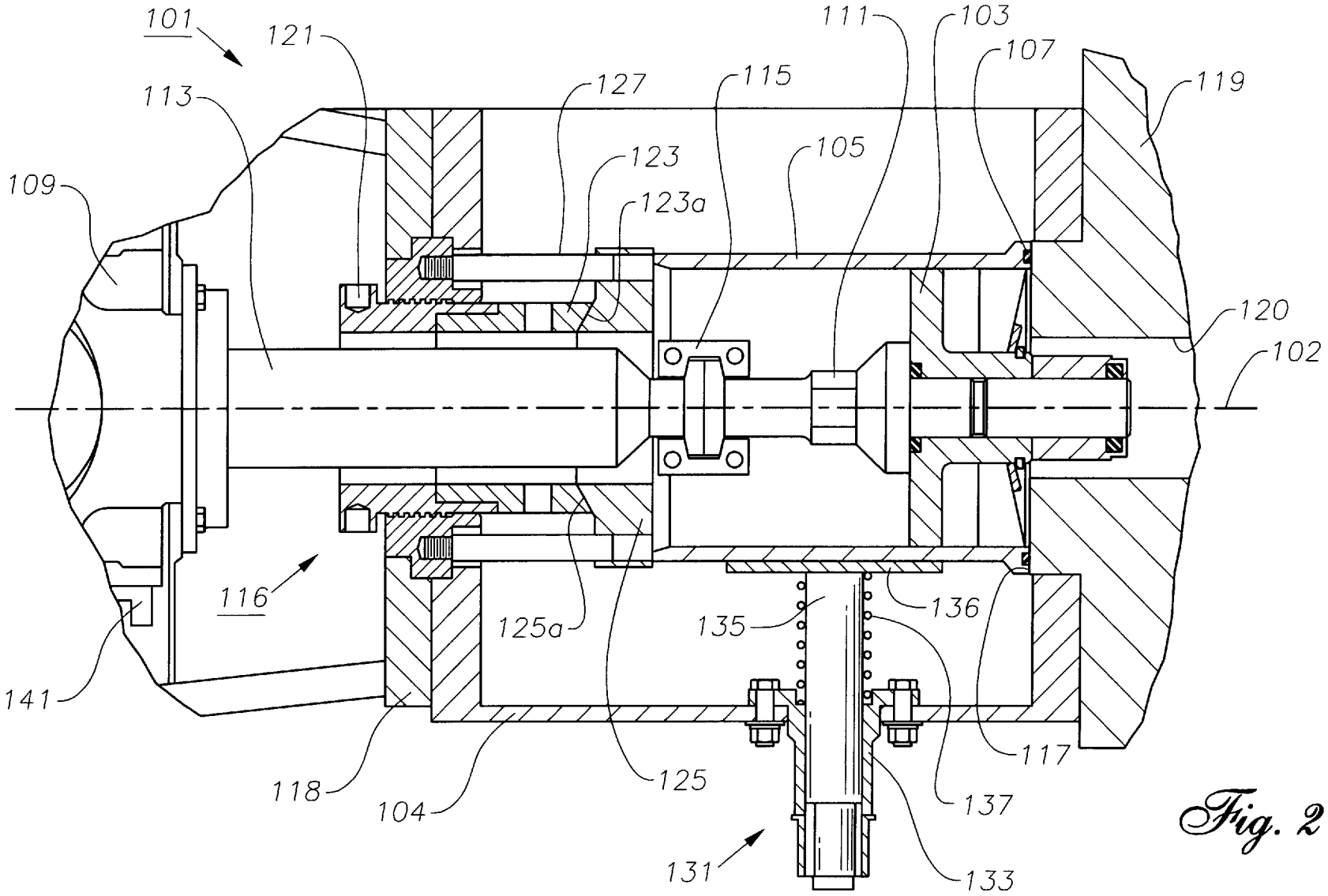
FIG. 2 is an enlarged sectional side view of the fluid end of a pump constructed in accordance with the invention.

The present invention is distinguished from the prior art pump of FIGS. 1A and 1B with an improved support structure and interface between the liner and the discharge module. Referring to FIG. 2, the present invention comprises an improved liner assembly for a reciprocating pump 101 having an axis 102 and an external housing 104. As in prior art systems, a coaxial piston 103, liner 105 and liner seal 107 are connected to a linearly reciprocating crosshead 109 through a piston rod 111 and pony rod 113 with a clamp 115. Once installed, liner 105 abuts a flat inward-facing wall 117 on fluid cylinder or manifold 119. An outward end of piston rod 111 reciprocates within a flow passage 120 in fluid manifold 119. Seal 107 is located on the outer end of liner 105 and prevents pressurized fluid leakage between liner 105 and manifold 119.

Liner 105 is biased or pressed against fluid manifold 119 by an adjustment mechanism 116 which is mounted to housing 104 and a bulkhead 118. Bulkhead 118 abuts an inward portion of housing 104 along on the power end side and is spaced apart axially inward from wall 117. In the preferred embodiment, adjustment mechanism 116 comprises an externally threaded pressure nut 121 which engages a threaded bore in housing 104 and bulkhead 118. Nut 121 abuts a bushing 123 along an outer edge, and bushing 123 abuts a flange 125. Flange 125 engages liner 105. Bushing 123 and flange 125 have mating spherical end portions 123*a*, 125*a*, respectively, for uniform transmission of pressure forces. Shaft or pony rod 113 extends axially through nut 121, bushing 123 and flange 125. A set of guide pins 127 extend between bulkhead 118 and flange 125, parallel to axis 102. Flange 125 slidingly engages guide pins 127, which prevent rotation of flange 125 relative to liner 105 while it is experiencing pressure from nut 121. Rotation of nut 121 moves flange 125 toward or away from liner 105.

FIG. 2 also shows the position of piston 103 and liner 105 relative to crosshead 109. As described above, liner 105 self-aligns to piston 103 with adjustment mechanism 116 and does not require a liner bushing.

A support device 131 is provided for assisting in the vertical alignment of liner 105 and piston 103. Support device 131 extends perpendicularly between housing 104 and liner 105 to support the weight of the liner assembly along its lower side. Support device 131 contains a guide bushing 133 which extends upward through a lower portion of housing 104, a cylindrical shaft 135 which is slidably adjustable relative to guide bushing 133, and a semi-cylindrical plate 136 welded to the upper end of shaft 135. Plate 136 is designed to conform to the lower end of liner 105. A coil spring 137 extends between bushing 133 and plate 136, and surrounds shaft 135 to bias liner 105 in an upward direction.

In operation, piston 103 and piston rod 111 are assembled to liner 105 outside of pump 101 (FIG. 2). For normal assembly, piston 103 must not bulge out of liner 105 from the side of seal 107. Piston rod 111 is connected to pony rod 113 by clamp 115, and support 131 is adjusted to vertically align piston 103 with passage 120. During this assembly, nut 121, bushing 123 and flange 125 are displaced toward crosshead 109. There is a small gap between liner 105 and manifold 119 prior to engagement. Further tightening of nut 121 pushes flange 125 which presses liner 105 against manifold 119. In this operation, liner 105 "self-aligns" to piston 103 independently of crosshead 109 and a crossway 141. Nut 121 presses liner 105 and liner seal 107 against wall 117 with an outward directed force which is reacted against housing 104. Once liner 105 is forced tightly against manifold 119, support device 131 has no further function.

The invention has several advantages. The pump does not require a liner bushing, and the axial separation between the manifolds is less than that of prior art pumps. Hence, the radial dimensions of the adjustment mechanism pressure parts (the nut, bushing and flange) have radial dimensions which are equal to or less than the maximum diameter of the liner. Uneven wear of the liner and piston is prevented, the lives of the parts are extended, and the need for liner bushings is eliminated. The overall size and weight of the pump is also minimized. For example, in a 500 horsepower pump the axial separation between the manifolds is 15.50" for a prior art design and 9.00" for the present invention design. In addition, the piston is easier to install and replace.

While the invention has been shown or described in only some of its forms, it should be apparent to those skilled in the art that it is not so limited, but is susceptible to various changes without departing from the scope of the invention.

I claim:

1. In a reciprocating pump having a fluid manifold which has a flow passage and an inward-facing wall, a crankshaft, a connecting rod for reciprocating a crosshead linearly along an axis, and a housing surrounding the crankshaft and the connecting rod and having an outer end secured to the fluid manifold, the improvement comprising:

a shaft secured to and extending outward from the crosshead along the axis;

a piston secured to the shaft;

a cylindrical liner coaxial with the shaft and closely receiving the piston;

a liner seal on an outer end of the liner which seals against the wall of the fluid manifold around the flow passage, the liner seal preventing fluid leakage between the liner and the flow passage; and an adjustment mechanism mounted to the housing and in engagement with the liner for pressing the liner and the liner seal against the wall of the fluid manifold with an outward directed force which is reacted against the housing.

2. The reciprocating pump of claim 1 wherein the adjustment mechanism comprises a threaded member which is adjusted by rotation along the axis.

3. The reciprocating pump of claim 1 wherein the housing has a bulkhead spaced apart from the inward facing wall of the manifold; and wherein the adjustment mechanism is mounted to the bulkhead.

4. The reciprocating pump of claim 1 wherein the adjustment mechanism comprises:

a threaded bore in the housing;

a pressure nut having external threads which engage the threaded bore, wherein the shaft extends through the pressure nut;

a flange for engaging the liner; and a bushing located between the nut and the flange, wherein rotating the nut moves the flange toward or away from the liner.

5. The reciprocating pump of claim 4 wherein the bushing and the flange have mating spherical end portions for uniform transmission of the pressure forces.

6. The reciprocating pump of claim 4 wherein the housing has a bulkhead spaced apart from the inward facing wall of the manifold; and wherein the liner has an inner end spaced apart from the bulkhead; and wherein the flange abuts the inner end of the liner.

7. The reciprocating pump of claim 4, wherein the adjustment mechanism further comprises a guide pin extending between the housing and the flange and slidingly engaging the flange for preventing rotation of the flange relative to the liner.

8. The reciprocating pump of claim 1, further comprising a spring-biased liner support device extending between a lower portion of the liner and a lower portion of the housing for supporting the liner prior to the adjustment mechanism pressing the liner against the wall.

9. A reciprocating pump having an axis, a fluid manifold with a flow passage and an inward-facing wall, a crankshaft, a crosshead, and a connecting rod for reciprocating the crosshead linearly along the axis, comprising:

a housing surrounding the crankshaft and the connecting rod and having an outer end secured to the fluid manifold;

a bulkhead between the crankshaft and the manifold;

a shaft secured to and extending outward from the crosshead along the axis and through the bulkhead;

a piston secured to the shaft;

a cylindrical liner coaxial with the shaft and closely receiving the piston;

a liner seal on an outer end of the liner which seals against the wall of the fluid manifold around the flow passage, the liner seal preventing fluid leakage between the liner and the flow passage; and a threaded member mounted to the bulkhead and in engagement with the liner for pressing the liner and the liner seal against the wall of the fluid manifold with an outward directed force which is reacted against the bulkhead, the threaded member being rotatable relative to the bulkhead for moving toward and away from the wall of the manifold along the axis.

10. The reciprocating pump of claim 9 wherein the threaded member comprises a pressure nut with external threads, and the shaft extends through the pressure nut; the reciprocating pump further comprising:

a threaded bore in the bulkhead, the external threads of the nut engaging the threaded bore;

a flange which engages the liner; and a bushing located between the nut and the flange, wherein rotating the nut advances the flange toward or away from the liner.

11. The reciprocating pump of claim 10 wherein the bushing and the flange have mating spherical end portions for uniform transmission of the pressure forces.

12. The reciprocating pump of claim 10 wherein the liner has an inner end spaced apart from the bulkhead; and wherein the flange abuts the inner end of the liner.

13. The reciprocating pump of claim 10, further comprising a guide pin extending between the bulkhead and the flange and slidingly engaging the flange for preventing rotation of the flange relative to the liner.

14. The reciprocating pump of claim 9, further comprising a spring extending between a lower portion of the liner and a lower portion of the housing for providing support to the liner prior to the adjustment mechanism pressing the liner against the wall.

15. In a reciprocating pump having a fluid manifold which has a flow passage and an inward-facing wall, a crankshaft, a connecting rod for reciprocating a crosshead linearly along an axis, and a housing surrounding the crankshaft and the connecting rod and having an outer end secured to the fluid manifold, the housing having a bulkhead spaced apart from the inward-facing wall, the improvement comprising:

a shaft secured to and extending outward from the crosshead along the axis;

a piston secured to the shaft;

a cylindrical liner coaxial with the shaft and closely receiving the piston;

a liner seal on an outer end of the liner which seals against the wall of the fluid manifold around the flow passage, the liner seal preventing fluid leakage between the liner and the flow passage;

a threaded bore in the bulkhead;

a pressure nut having external threads which engage the threaded bore, wherein the shaft extends through the pressure nut;

a flange for engaging the liner; and a bushing located between the nut and the flange, wherein rotating the nut in one direction advances the flange toward the liner for pressing the liner and the liner seal against the wall of the fluid manifold with an outward directed force which is reacted against the bulkhead.

16. The reciprocating pump of claim 15, further comprising a guide pin extending between the bulkhead and the flange and slidingly engaging the flange for preventing rotation of the flange relative to the liner.

17. The reciprocating pump of claim 15, further comprising an adjustable liner support device extending between a lower portion of the liner and a lower portion of the housing for supporting the liner prior to the flange pressing the liner against the wall of the fluid manifold.

18. A method for assembling a power end of a reciprocating pump to a fluid manifold of the pump, the fluid manifold having a flow passage and an inward-facing wall, and the power end having a crankshaft, a connecting rod for reciprocating a crosshead linearly along an axis, a housing surrounding the crankshaft and the connecting rod and having an outer end secured to the fluid manifold, and a shaft extending outward from the crosshead along the axis, the method comprising:

(a) securing a piston to one end of the shaft;

(b) inserting the piston into a liner; then (c) pressing the liner against the wall of the fluid manifold with an outward directed force which is reacted against the housing for preventing fluid leakage between the liner and the flow passage.

19. The method of claim 18 wherein step (c) comprises rotating a threaded member along the axis to force the liner against the wall.

20. The method of claim 18, further comprising prior to step (c) applying an upward force to the liner to hold the liner and shaft generally coaxial with the axis.

* * * * *